US011644028B2

(12) United States Patent
Kardell et al.

(10) Patent No.: US 11,644,028 B2
(45) Date of Patent: May 9, 2023

(54) CONTROL ARRANGEMENT FOR VARIABLE DISPLACEMENT PUMP

(71) Applicant: Danfoss Power Solutions Inc., Ames, IA (US)

(72) Inventors: Doug Kardell, Grimes, IA (US); Stanislav Smolka, Povazska Bystrica (SK)

(73) Assignee: Danfoss Power Solutions, Inc., Ames, IA (US)

( * ) Notice: Subject to any disclaimer, the term of this patent is extended or adjusted under 35 U.S.C. 154(b) by 345 days.

(21) Appl. No.: 16/843,166

(22) Filed: Apr. 8, 2020

(65) Prior Publication Data

US 2021/0317827 A1 Oct. 14, 2021

(51) Int. Cl.

| | |
|---|---|
| ***F04B 49/08*** | (2006.01) |
| ***F04B 9/04*** | (2006.01) |
| ***F04B 1/295*** | (2020.01) |
| ***F04B 49/00*** | (2006.01) |
| ***F04B 49/12*** | (2006.01) |

(52) U.S. Cl.

CPC ..... *F04B 49/08* (2013.01); *F04B 1/295* (2013.01); *F04B 9/042* (2013.01); *F04B 49/002* (2013.01); *F04B 49/12* (2013.01); *F04B 2203/0207* (2013.01)

(58) Field of Classification Search

CPC ..... F04B 1/295; F04B 9/042; F04B 9/045; F04B 49/002; F04B 49/08; F04B 49/12

USPC ..... 92/13; 91/505

See application file for complete search history.

(56) References Cited

U.S. PATENT DOCUMENTS

2008/0041223 A1* 2/2008 Takahashi ..... F04B 1/22 91/505

2010/0199838 A1* 8/2010 Krebs ..... F04B 1/324 417/269

* cited by examiner

*Primary Examiner* — Alexander B Comley

(74) *Attorney, Agent, or Firm* — McCormick, Paulding & Huber PLLC

(57) ABSTRACT

A control arrangement for a variable displacement pump includes a pressure control unit and a separate mechanical control unit, each mounted on a housing of the variable displacement pump. The pressure control unit provides pressure control for the variable displacement pump and the mechanical control unit provides rotary feedback control for the variable displacement pump.

11 Claims, 11 Drawing Sheets

PC & LS & EDC W/Negative Logic

CONTROL ARRANGEMENT FOR VARIABLE DISPLACEMENT PUMP

TECHNICAL FIELD

The present disclosure relates to control arrangements for variable displacement pumps.

BACKGROUND

Variable displacement pumps typically include controllers that control pump displacement through one or more of pressure compensation, load sensing, electric displacement control, mechanical torque control, and/or electric torque control. The electric displacement control, mechanical torque control, and/or electric torque control systems are typically included within a servo bore of the pump housing designed specifically for the pump frame size.

SUMMARY

The present disclosure provides control arrangement for a variable displacement pump that overcome the deficiencies of the known pumps discussed above.

According to the present disclosure, a control arrangement for a variable displacement pump comprises a pressure control unit providing at least one of pressure compensation control or load sensing control, and a mechanical control unit providing at least one of mechanical torque control, electronic torque control, or electronic displacement control. The pressure control unit attaches to the variable displacement pump at a first interface and the mechanical control unit attaches to the variable displacement pump at a second interface that is different than the first interface.

According to the present disclosure, the mechanical control unit may comprise a housing including a pump mating surface configured to interface with the variable displacement pump at the second interface. The mechanical control unit includes a cam shaft disposed within the housing that has a distal end extending outward from the housing at the pump mating surface. The distal end of the cam shaft may be configured to engage a servo piston controlling displacement of the variable displacement pump when the mechanical control assembly is mounted to the variable displacement pump.

According to the present disclosure, the control arrangement may further comprise a sensor assembly configured to detect an angle of the cam shaft to determine pump displacement.

According to the present disclosure, the mechanical control unit comprises a rotary feedback assembly configured to monitor actuation of the servo piston controlling displacement of the variable displacement pump. The rotary feedback assembly controls actuation of the servo piston based at least on the monitored actuation. According to the present disclosure, the rotary feedback assembly comprises the cam shaft configured to engage the servo piston. A control spool controlling actuation of the servo piston is actuated at least in part due to rotary motion of the cam shaft. The rotary feedback assembly may further comprise a pressure setpoint adjuster the control spool may control actuation of the servo piston based at least in part on rotary motion of the cam shaft and a pressure setpoint defined by the pressure setpoint adjuster.

According to the present disclosure, a control arrangement for a variable displacement pump comprises a pressure control unit providing at least one of pressure compensation control or load sensing control, and a mechanical control unit providing at least one of mechanical torque control, electronic torque control, or electronic displacement control. The pressure control unit is configured to attach to the variable displacement pump at a first mounting surface and the mechanical control unit is configured to attach to the variable displacement pump at a second mounting surface formed on an opposite side of the variable displacement pump from the first mounting surface.

According to the present disclosure, the mechanical control unit may comprise a housing including a pump mating surface configured to interface with the variable displacement pump at the second mounting surface, and a cam shaft disposed within the housing and having a distal end extending outward from the housing at the pump mating surface. The distal end of the cam shaft is configured to engage a servo piston controlling displacement of the variable displacement pump when the mechanical control assembly is mounted to the variable displacement pump.

According to the present disclosure, the control arrangement may further comprise a sensor assembly configured to detect an angle of the cam shaft to determine pump displacement.

According to the present disclosure, the mechanical control unit may comprise a rotary feedback assembly configured to monitor actuation of a servo piston controlling displacement of the variable displacement pump and to control actuation of the servo piston based at least on the monitored actuation. According to the present disclosure, the rotary feedback assembly comprises the cam shaft configured to engage the servo piston. A control spool controlling actuation of the servo piston is actuated at least in part due to rotary motion of the cam shaft. The rotary feedback assembly may further comprise a pressure setpoint adjuster the control spool may control actuation of the servo piston based at least in part on rotary motion of the cam shaft and a pressure setpoint defined by the pressure setpoint adjuster.

According to the present disclosure, the rotary feedback assembly may further comprise a rocker arm rotatably driven by the cam shaft, and a feedback pin carried by the cam shaft and in contact with the rocker arm, the feedback pin being biased against the rocker arm by a working pressure of the variable displacement pump. The control spool may control actuation of the servo piston based at least in part on rotary motion of the cam shaft, a moment on the rocker arm due to the feedback pin, and a pressure setpoint defined by the pressure setpoint adjuster.

According to the present disclosure, a control arrangement for a variable displacement pump comprises a mechanical control unit providing at least one of mechanical torque control, electronic torque control, or electronic displacement control. The mechanical control unit comprises a housing including a pump mating surface configured to interface with the variable displacement pump, and a cam shaft disposed within the housing and having a distal end extending outward from the housing at the pump mating surface. The distal end of the cam shaft is configured to engage a servo piston controlling displacement of the variable displacement pump when the mechanical control assembly is mounted to the variable displacement pump.

According to the present disclosure, the control arrangement may further comprise a sensor assembly configured to detect an angle of the cam shaft to determine pump displacement.

According to the present disclosure, the mechanical control unit comprises a rotary feedback assembly configured to monitor actuation of a servo piston through the cam shaft and to control displacement of the variable displacement pump through actuation of the servo piston based at least on rotary motion of the cam shaft. The rotary feedback assembly may control movement of a control spool based at least in part on rotary motion of the cam shaft, the control spool controlling actuation of the servo piston. The rotary feedback assembly may further comprise a pressure setpoint adjuster controlling movement of the control spool and the control spool may control actuation of the servo piston based at least in part on rotary motion of the cam shaft and a pressure setpoint defined by the pressure setpoint adjuster. According to the present disclosure, the rotary feedback assembly may further comprise a rocker arm rotatably driven by the cam shaft, and a feedback pin carried by the cam shaft and in contact with the rocker arm, the feedback pin being biased against the rocker arm by a working pressure of the variable displacement pump. The control spool may control actuation of the servo piston based at least in part on rotary motion of the cam shaft, a moment on the rocker arm due to the feedback pin, and a pressure setpoint defined by the pressure setpoint adjuster.

These and other objects, features and advantages of the present disclosure will become apparent in light of the detailed description of embodiments thereof, as illustrated in the accompanying drawings.

DETAILED DESCRIPTION

Figure 1:
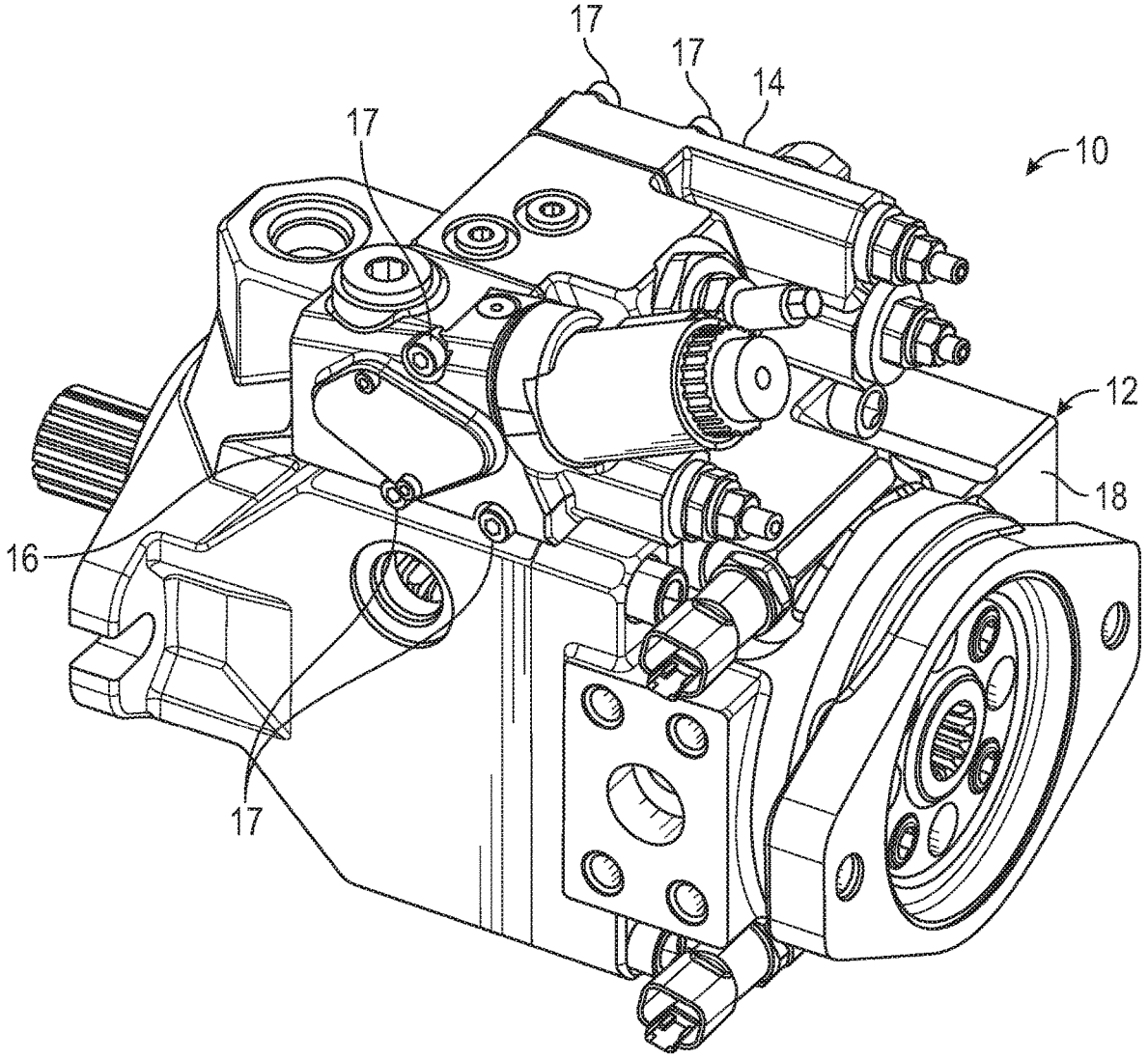
FIG. 1 is a top, rear, right-hand side perspective view of a variable displacement pump including a control arrangement according to the present disclosure.

Before the various embodiments are described in further detail, it is to be understood that the invention is not limited to the particular embodiments described. It will be understood by one of ordinary skill in the art that the control arrangements and systems described herein may be adapted and modified as is appropriate for the application being addressed and that the control arrangements and systems described herein may be employed in other suitable applications, and that such other additions and modifications will not depart from the scope thereof.

In the drawings, like reference numerals refer to like features of the systems of the present application. Accordingly, although certain descriptions may refer only to certain figures and reference numerals, it should be understood that such descriptions might be equally applicable to like reference numerals in other figures.

Referring to FIG. 1, a control arrangement 10 for a variable displacement pump 12 according to the present disclosure is shown. The control arrangement 10 includes a pressure control unit 14 and a mechanical control unit 16, each mounted separately on a housing 18 of the variable displacement pump 12 by bolts 17 or the like. The variable displacement pump 12 is an open circuit variable displacement pump that includes a cylinder block having plurality of pistons and a swashplate controlling displacement of the plurality of pistons, with an angle of the swashplate, and therefore the displacement of the pump, being controlled by the control arrangement 10. The pressure control unit 14 provides pressure control for the variable displacement pump 12, for example, through a pressure compensator, load sensing, an electric pressure compensator, or combinations thereof. The mechanical control unit 16 provides rotary feedback control for the variable displacement pump 12, for example, through Electric Displacement Control (EDC), Mechanical Torque Control (MTC), or Electric Torque Control (ETC).

Figure 2:
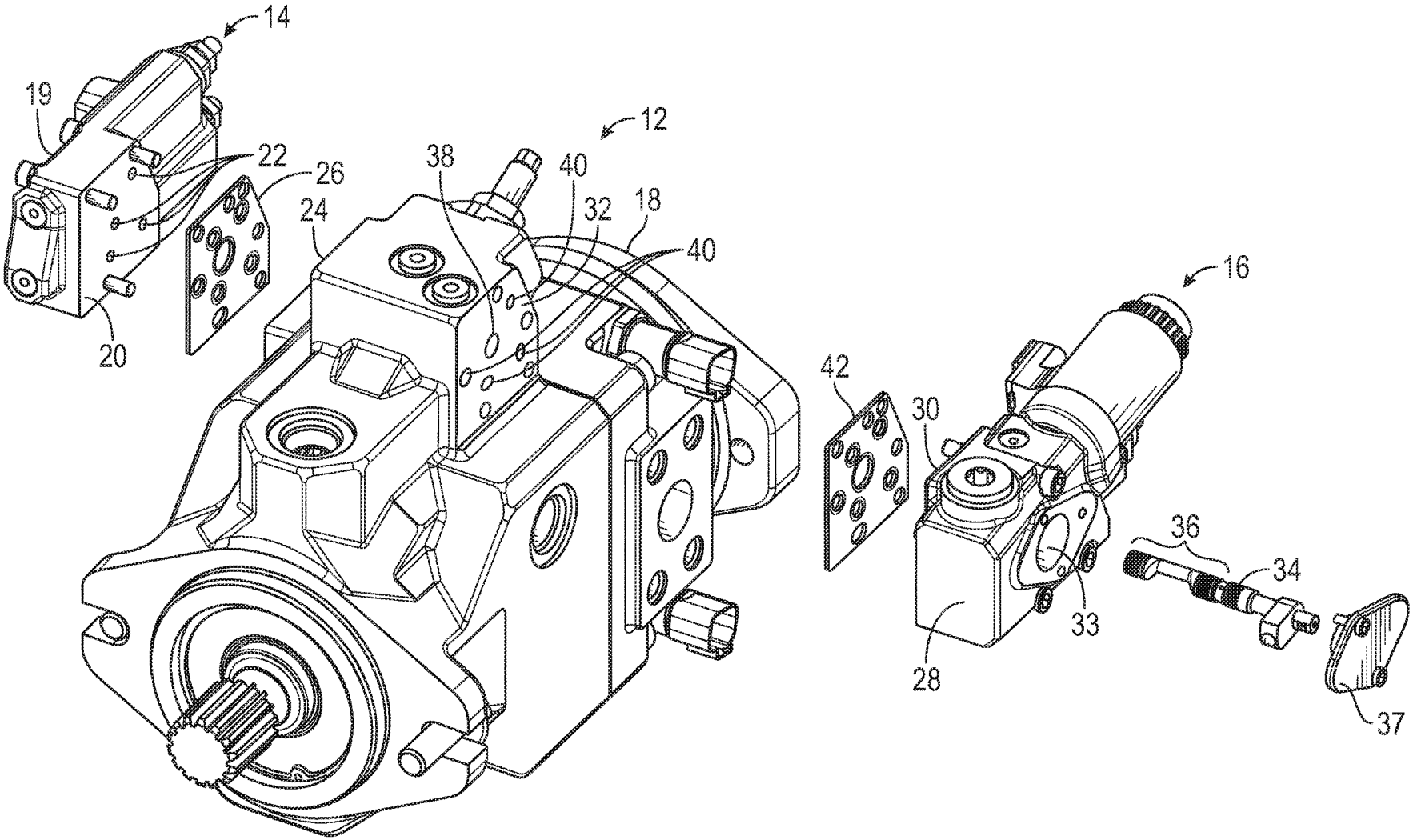
FIG. 2 is a partially exploded top, front, right-hand side perspective view of the variable displacement pump and control arrangement of FIG. 1.

Referring to FIG. 2, the pressure control unit 14 includes a pressure control unit housing 19 with a pump mating surface 20 that includes pressure ports 22 formed therethrough forming pressure inlets and/or outlets to the pressure control unit 14. The pump mating surface 20 is configured to engage a corresponding pressure control mounting surface 24 formed on the housing 18 of the variable displacement pump 12. The pressure control mounting surface 24 includes pressure ports corresponding to the pressure ports 22 of the pump mating surface 20, which interact with the pressure ports 22 of the pump mating surface 20 when the pressure control unit 14 is mounted to the housing 18. A seal carrier 26 may be provided between the pump mating surface 20 and the pressure control mounting surface 24 to provide sealing around the pressure ports 22. As discussed above, the pressure control unit 14 may provide pressure control for the variable displacement pump 12 through a pressure compensator, load sensing, an electric pressure compensator, or combinations thereof and pump mating surface 20 has the same configuration regardless of which control is implemented.

The mechanical control unit 16 includes a mechanical control unit housing 28 with a pump mating surface 30 configured to engage a corresponding mechanical control mounting surface 32 formed on the housing 18 of the variable displacement pump 12. The mechanical control unit 16 comprises a transverse bore 33 extending through the mechanical control unit housing 28 and opening at one end at the pump mating surface 30. A cam shaft 34 is positioned within the transverse bore 33 and has a distal end portion 36 extending outward from the mechanical control unit housing 28 through the opening at the pump mating surface 30. The other end of the transverse bore 33 opposite the pump mating surface 30 may be closed by a removable cover 37. In addition to the opening of the transverse bore 33 for the distal end portion 36 of cam shaft 34, the pump mating surface 30 also includes pressure ports formed therethrough forming pressure inlets and/or outlets to the mechanical control unit 16.

The mechanical control mounting surface 32 of the housing 18 includes a cam shaft opening 38 configured to receive the distal end portion 36 of the cam shaft 34 when the mechanical control unit 16 is mounted to the housing 18. The mechanical control mounting surface 32 also includes pressure ports 40 corresponding to the pressure ports of the pump mating surface 30, which interact with the pressure ports of the pump mating surface 30 when the mechanical control unit 16 is mounted to the housing 18. A seal carrier 42 may be provided between the pump mating surface 30 and the mechanical control mounting surface 32 to provide sealing around the pressure ports. While the seal carrier 42 may have a different seal layout than the seal carrier 26, the pressure ports of the pressure control unit 14 and the pressure ports of the mechanical control unit 16 may also be provided on the respective pump mating surfaces in the same layout to allow for the use of a common seal carrier for both the seal carrier 26 and the seal carrier 42. As discussed above, the mechanical control unit 16 may provide rotary feedback control for the variable displacement pump 12 EDC, MTC, or ETC control techniques and pump mating surface 30 and distal end 36 of cam shaft 34 have the same configuration regardless of which control is implemented.

Figure 3:
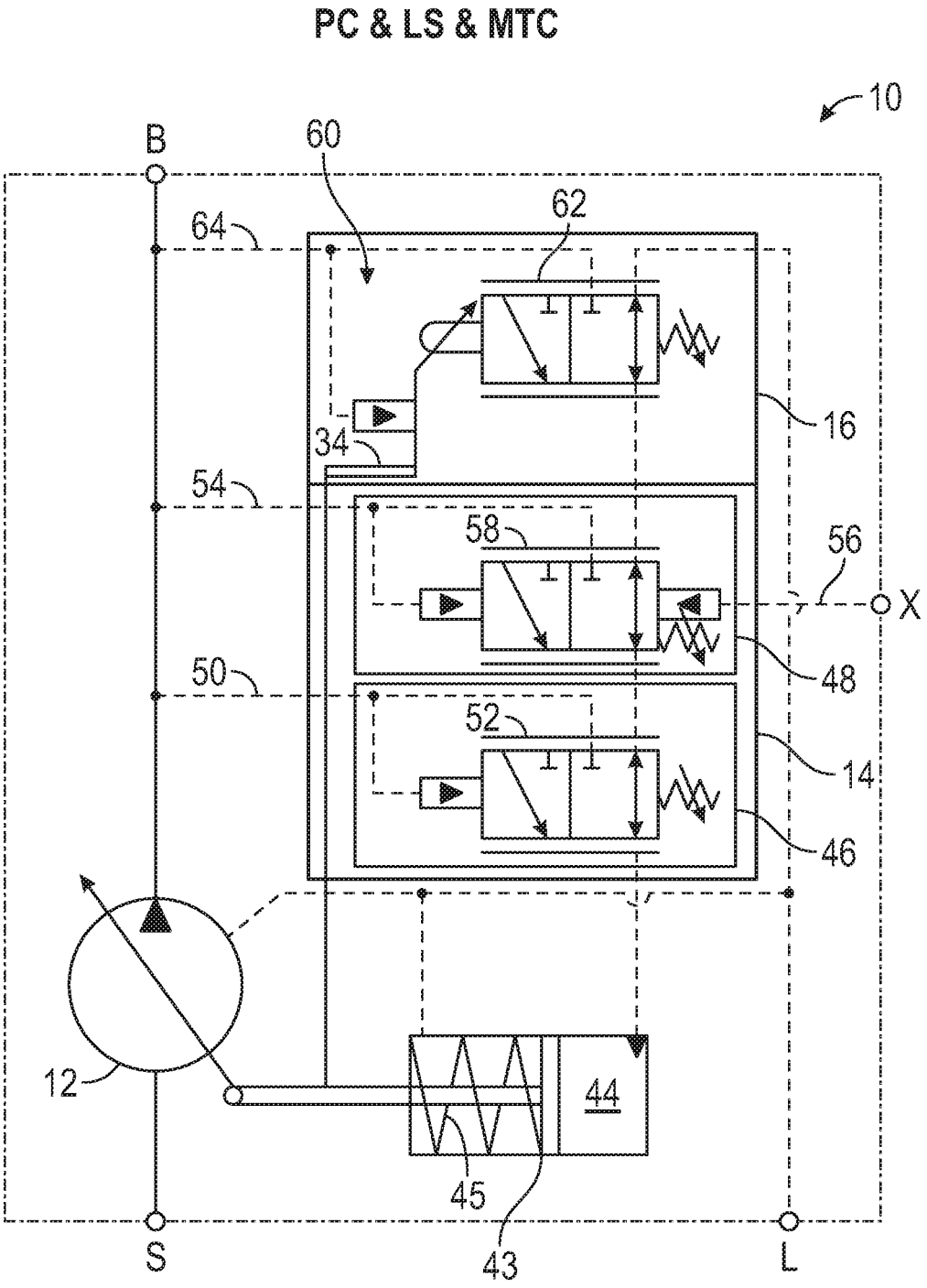
FIG. 3 a schematic diagram of the control arrangement of FIG. 1 in a first configuration.

Referring to FIG. 3, a schematic view of a first configuration of the control arrangement 10 for controlling variable displacement pump 12 through a servo piston 43 is shown. As shown, the servo piston 43 is a single acting hydraulic cylinder, where the supply of hydraulic fluid to chamber 44 controls movement of the servo piston 43 in one direction and a spring 45 controls movement of the servo piston 43 in the opposite direction. The servo piston 43 controls the angle of the swashplate of the variable displacement pump 12 and, therefore, the displacement of the pump. As shown, the mechanical control unit 16 is in an MTC configuration and the pressure control unit 14 includes a pressure compensator control portion 46 and a load sensing control portion 48.

The pressure compensator portion 46 operates in the same manner as other known pressure compensation controllers by using pump outlet pressure to control the position of the servo piston 43. Specifically, the pressure compensator portion 46 receives pump outlet pressure from the variable displacement pump 12 via pressure input 50, which is provided through one of the pressure ports 22, shown in FIG. 2, of the pressure control unit 14. When the pump outlet pressure exceeds a predetermined maximum working pressure, a control spool 52 of the pressure compensator portion 46 actuates to a servo pressure-increasing position, thereby providing hydraulic fluid to increase the pressure in chamber 44, which moves the servo piston 43 to increase the displacement of the variable displacement pump 12.

The load sensing portion 48 also operates in the same manner as other known load sensing controllers by using pump outlet pressure and a load feedback pressure to control the position of the servo piston 43. Specifically, the load sensing portion 48 receives pump outlet pressure from the variable displacement pump 12 via pressure input 54 and load feedback pressure via pressure input 56, which are provided through pressure ports 22, shown in FIG. 2, of the pressure control unit 14. The load sensing portion 48 monitors and compares pressure values for the pump outlet pressure and load feedback pressure. When the pump outlet pressure is not equal to a sum of the load sensing feedback pressure and a load sensing set value, a control spool 58 of the load sensing portion 48 moves to increase or decrease the pressure in chamber 44, which moves the servo piston 43 to alter the displacement of the variable displacement pump 12 until the pump outlet pressure is equal to the sum of the load feedback pressure and the load sensing set value.

The mechanical control unit 16 includes a rotary feedback assembly 60 controlling actuation of a control spool 62 using rotary input from cam shaft 34 and pump outlet pressure provided via pressure input 64, which is provided through one of the pressure ports of the mechanical control unit 16. Actuation of the control spool 62 increases or decreases the pressure in chamber 44, which moves the servo piston 43 to alter the displacement of the variable displacement pump 12 until a torque control setpoint is reached.

Figure 4:
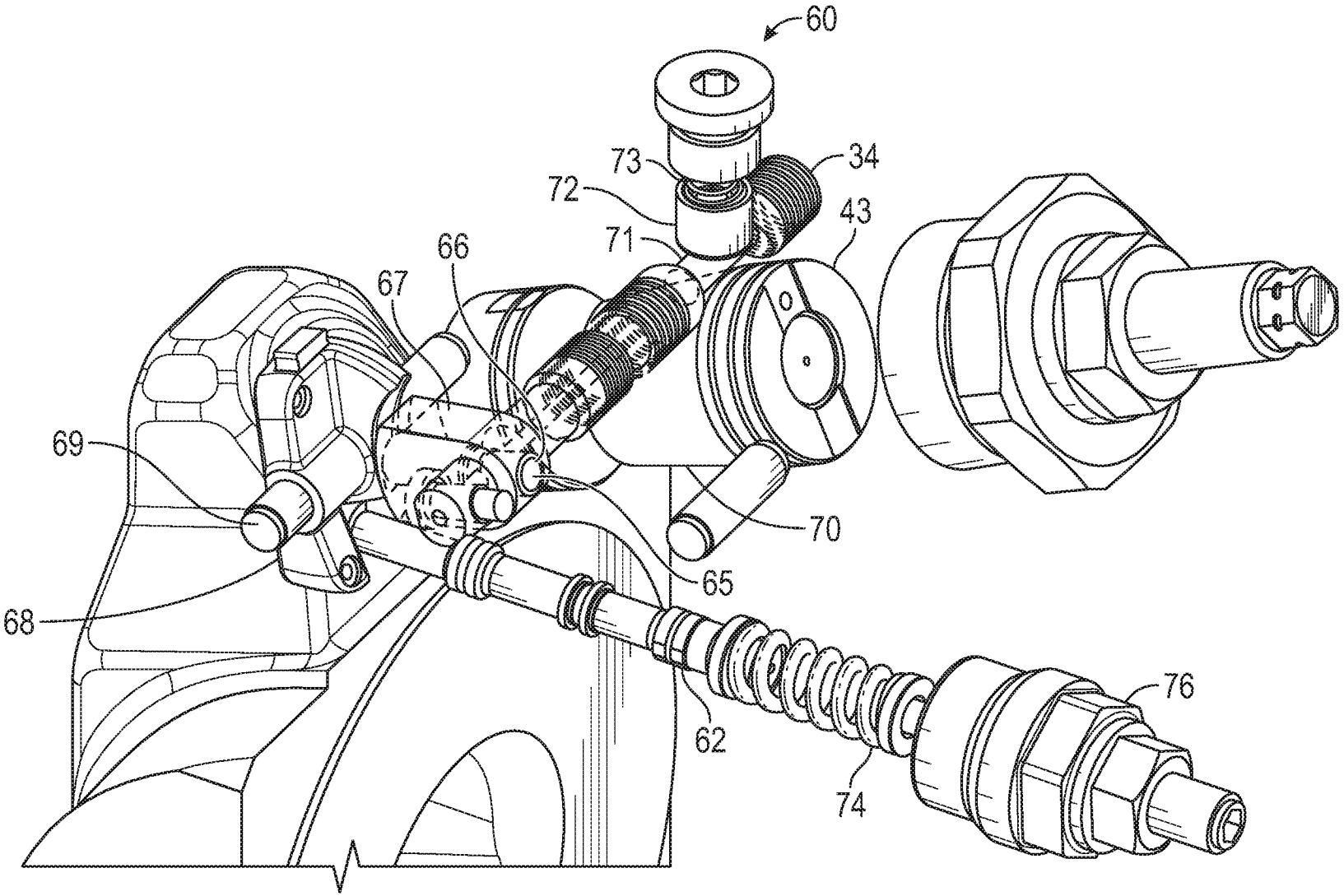
FIG. 4 is an internal perspective view of a mechanical control unit of the control arrangement of FIG. 1 in the first configuration.

Referring to FIG. 4, the rotary feedback assembly 60 includes the cam shaft 34, a feedback pin 65 disposed within a bore 66 formed in a head 67 of the cam shaft 34, and a rocker arm 68 that pivots about a pivot point 69. The cam shaft 34 is rotatable in the transverse bore 33 and cam shaft opening 38 of pump housing 18, shown in FIG. 2. The cam shaft opening 38 of the pump housing 18, shown in FIG. 2, intersects a servo piston bore for servo piston 43. The servo piston 43 includes a tapered portion 70 at the intersection between the servo piston bore and the cam shaft opening 38. The cam shaft 34 includes an eccentric shoulder 71 that slides on the tapered portion 70 of the servo piston 43, such that the cam shaft 34 is driven in rotary motion in response to movement of the servo piston 43. A plunger 72 biased by a spring 73 engages the cam shaft 34 to maintain contact between the cam shaft 34 and servo piston 43.

The feedback pin 65 in the head 67 of cam shaft 34 acts against the rocker arm 68 in response to system pressure, i.e., pump outlet pressure provided via pressure input 64, shown in FIG. 3. Specifically, the system pressure acts on the feedback pin 65 against rocker arm 68. As the servo piston 43 strokes and pump displacement gets smaller, cam shaft 34 rotates due to movement of the tapered portion 70 and a moment arm between feedback pin 65 and the pivot point 69 of rocker arm 68 gets smaller. Conversely, pump displacement at maximum will make the moment arm between feedback pin 65 and pivot point 69 of rocker arm 68 the largest. The moveable control spool 62 is balanced between the rocker arm 68 on one end and an adjustable spring 74 on the other end, which is adjustable via a mechanical adjuster 76. The control spool 62 and adjustable spring 74 are concentrically located at a constant distance from pivot point 69 of rocker arm 68. When the moment of the feedback pin 65 on the rocker arm 68 becomes larger than a moment from adjustable spring 74, the control spool 62 moves to communicate hydraulic oil at system pressure to chamber 44 of servo piston 43, shown in FIG. 3. When the moment of the feedback pin 65 the on rocker arm 68 is smaller than the moment from adjustable spring 74 on the rocker arm 68, the control spool 62 moves to vent servo pressure oil in chamber 44 of the servo piston 43 to pump case 18, shown in FIG. 2. The MTC pressure set point is reached when the moment of the feedback pin 65 on the rocker arm 68 and the moment of the adjustable spring 74 on the rocker arm 68 are balanced and control spool 62 is centered in a metering position.

Figure 5:
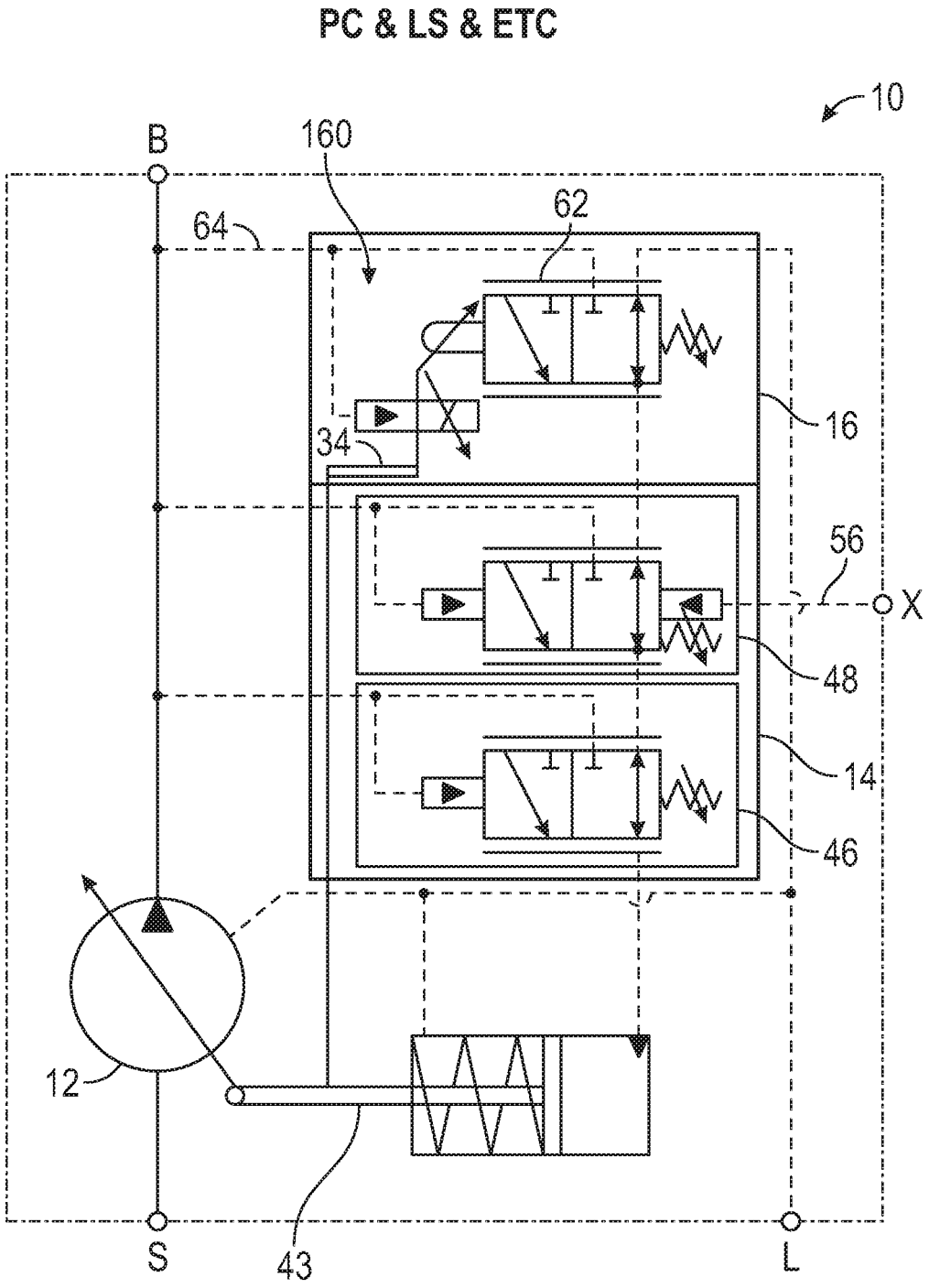
FIG. 5 a schematic diagram of the control arrangement of FIG. 1 in a second configuration.

Referring to FIG. 5, wherein like numerals represent like elements, a schematic view of a second configuration of the control arrangement 10 for controlling variable displacement pump 12 through servo piston 43 is shown. In the second configuration, the mechanical control unit 16 is in an ETC configuration rather than an MTC configuration. The control arrangement 10 is, otherwise, identical to the control arrangement 10 shown in FIG. 3 and, therefore, the details of the pressure control unit 14 including pressure compensator control portion 46 and load sensing control portion 48 will not be discussed again in detail. The mechanical control unit 16 includes a rotary feedback assembly 160 controlling actuation of control spool 62 using rotary input from cam shaft 34 and pump outlet pressure provided via pressure input 64, which is provided through one of the pressure ports of the mechanical control unit 16. The only difference between the rotary feedback assembly 160 and the rotary feedback assembly 60 shown in FIGS. 3 and 4 is that the rotary feedback assembly 160 includes an electronic adjuster in place of the mechanical adjuster 76, shown in FIG. 4, for adjusting the adjustable spring 74. The rotary feedback assembly 160 is, otherwise, identical in structure and operation to the rotary feedback assembly 60 shown in FIGS. 3 and 4 for controlling actuation of control spool 62 to increase and decrease pressure in chamber 44 to move servo piston 43 until the torque control setpoint is reached and, therefore, the details of the rotary feedback assembly 160 will not be discussed again in detail.

Figure 6:
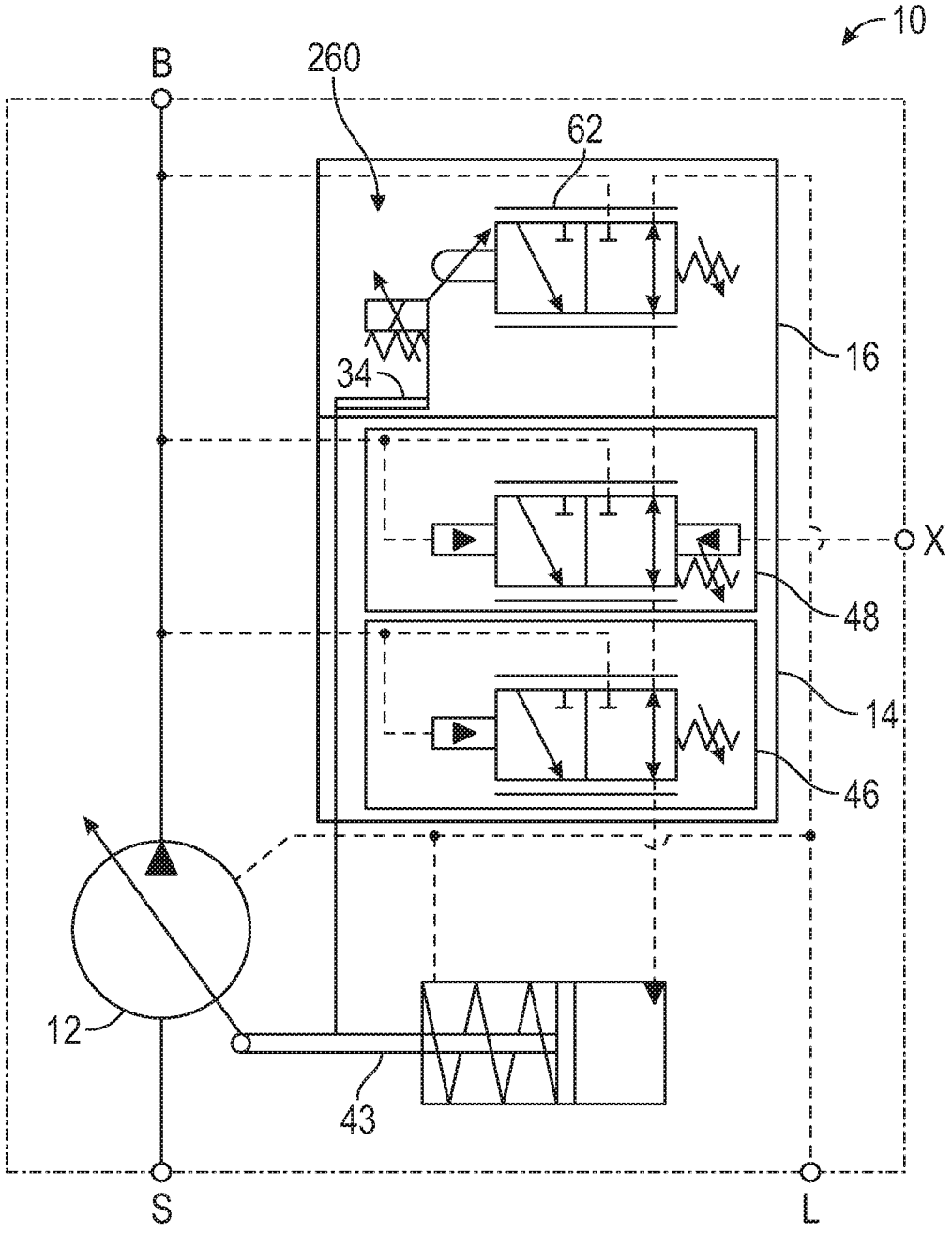
FIG. 6 a schematic diagram of the control arrangement of FIG. 1 in a third configuration.

Referring to FIG. 6, wherein like numerals represent like elements, a schematic view of a third configuration of the control arrangement 10 for controlling variable displacement pump 12 through servo piston 43 is shown. In the third configuration, the mechanical control unit 16 is in a first EDC configuration rather than an MTC or ETC configuration. The pressure control unit 14, including pressure compensator control portion 46 and load sensing control portion 48, of the control arrangement 10 is identical to the pressure control unit 14 shown in FIG. 3 and, therefore, the details of the pressure control unit 14 will not be discussed again in detail. The mechanical control unit 16 includes a rotary feedback assembly 260 controlling actuation of control spool 62 using rotary input from cam shaft 34 and an electronically set control setpoint.

Figure 7:
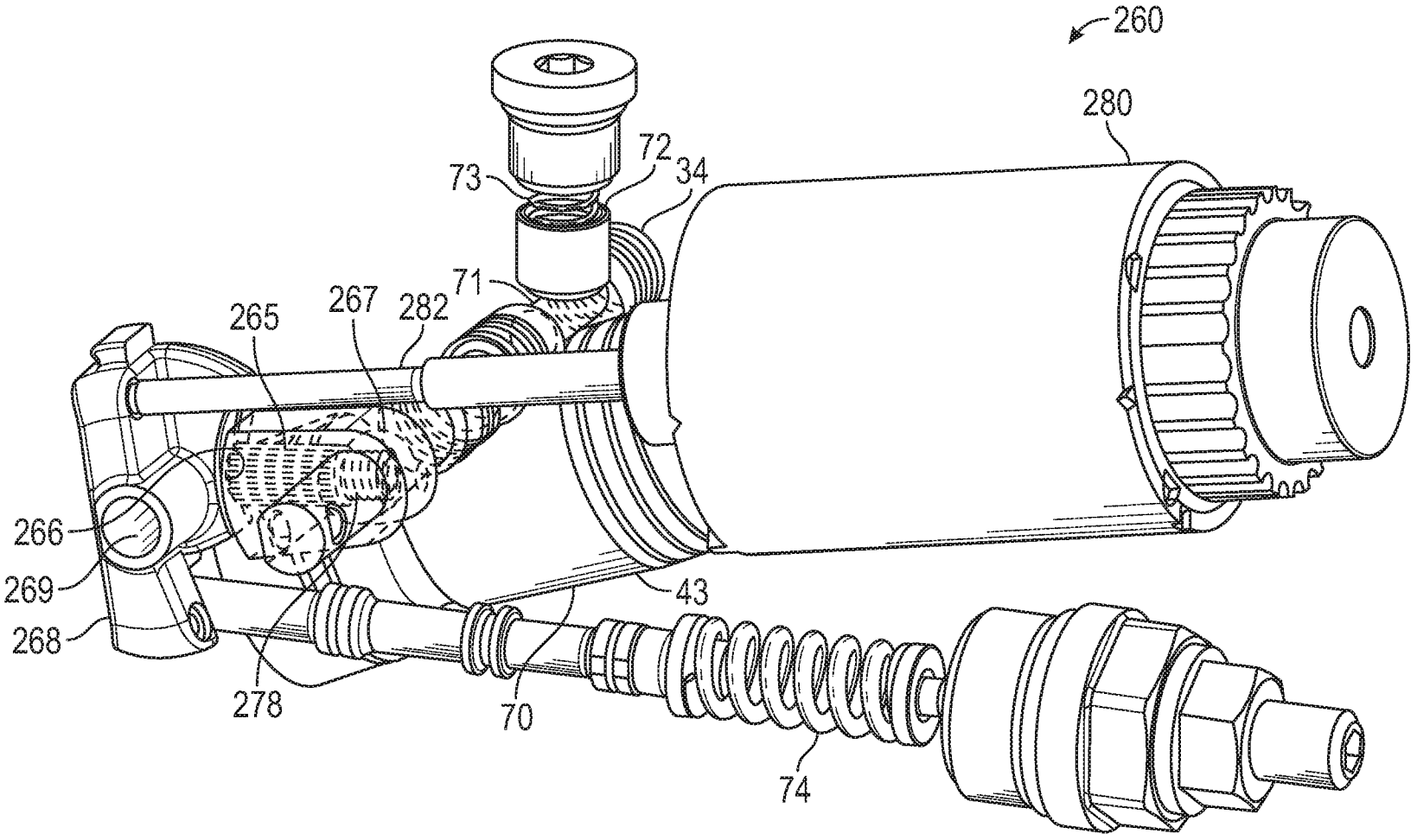
FIG. 7 is an internal perspective view of a mechanical control unit of the control arrangement of FIG. 1 in the third configuration.

Referring to FIG. 7, the rotary feedback assembly 260 includes the cam shaft 34, a feedback pin 265 disposed within a bore 266 formed in a head 267 of the cam shaft 34, and a rocker arm 268 that pivots about a pivot point 269. The rotary feedback assembly 260 also includes a spring 278 disposed within bore 266 adjacent the feedback pin 265 and providing a constant load on the feedback pin 265 against the rocker arm 268. The rotary feedback assembly 260 includes a solenoid actuator 280 driving an actuator rod 282 positioned between the solenoid actuator 280 and the rocker arm 268.

The cam shaft 34 is rotatable in the transverse bore 33 and cam shaft opening 38 of pump housing 18, shown in FIG. 2. The cam shaft opening 38 of the pump housing 18, shown in FIG. 2, intersects a servo piston bore for servo piston 43. The servo piston 43 includes tapered portion 70 at the intersection between the servo piston bore and the cam shaft opening 38. The cam shaft 34 includes eccentric shoulder 71 that slides on the tapered portion 70 of the servo piston 43, such that the cam shaft 34 is driven in rotary motion in response to movement of the servo piston 43. Plunger 72 biased by spring 73 engages the cam shaft 34 to maintain contact between the cam shaft 34 and servo piston 43. Force from the solenoid actuator 280 is exerted on rocker arm 268 via the actuator rod 282 to shift a control set point maintained by adjustable spring 74.

Figure 8:
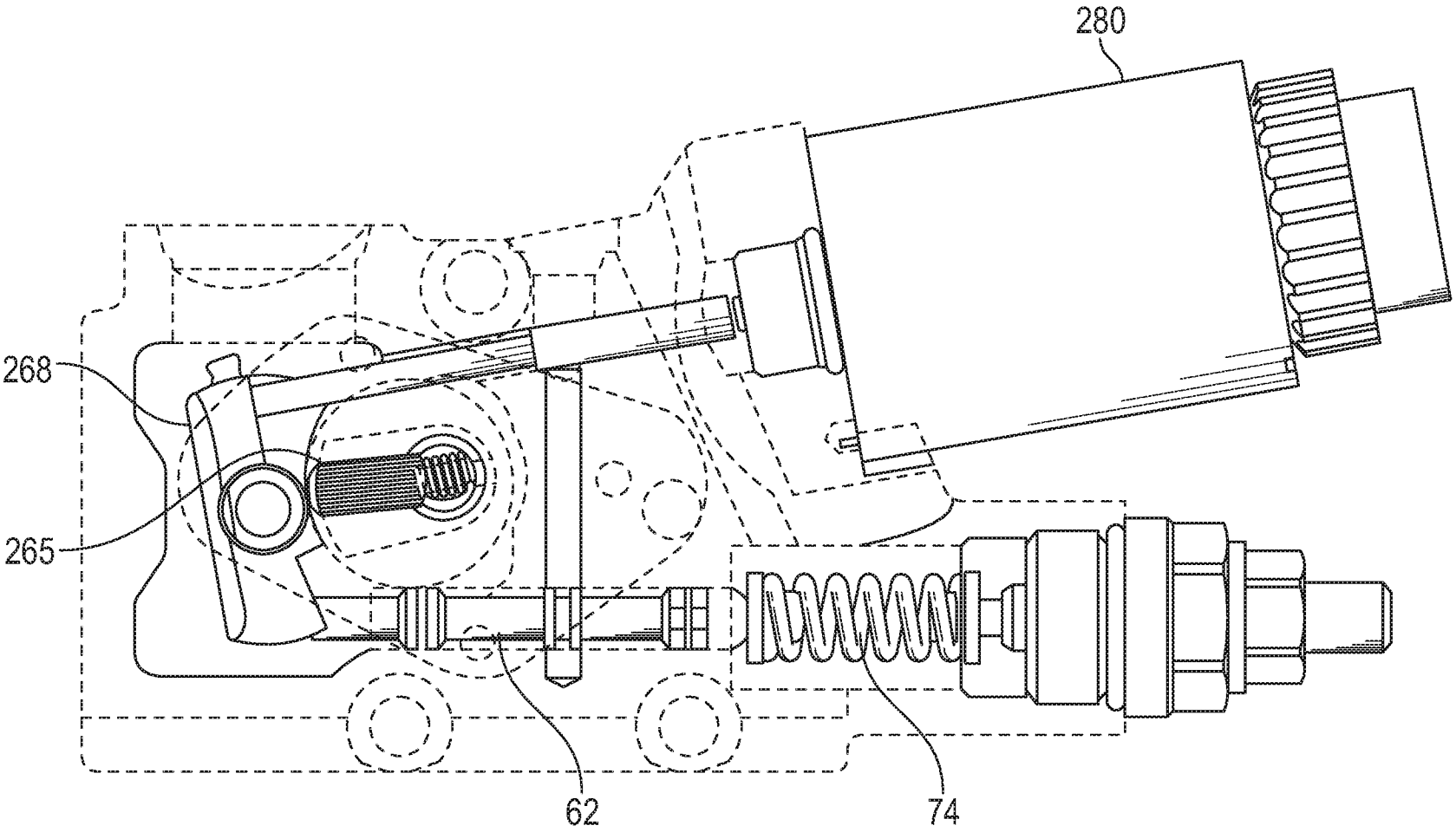
FIG. 8 is a partial cross sectional view of the mechanical control unit of FIG. 7.

Referring to FIG. 8, if a moment generated by the solenoid actuator 280 on rocker arm 268 acts in the same direction as a moment on the rocker arm 268 from the feedback pin 265, the control set point, which is the desired outlet flow at a given shaft speed, decreases in response to actuation of the solenoid actuator 280. The control set point is reached when the moment from the feedback pin 265 on rocker arm 268, the moment from adjustable spring 74 on rocker arm 268, and the moment from solenoid actuator 280 on rocker arm 268 are balanced and control spool 62 is centered in metering position.

Figure 9:
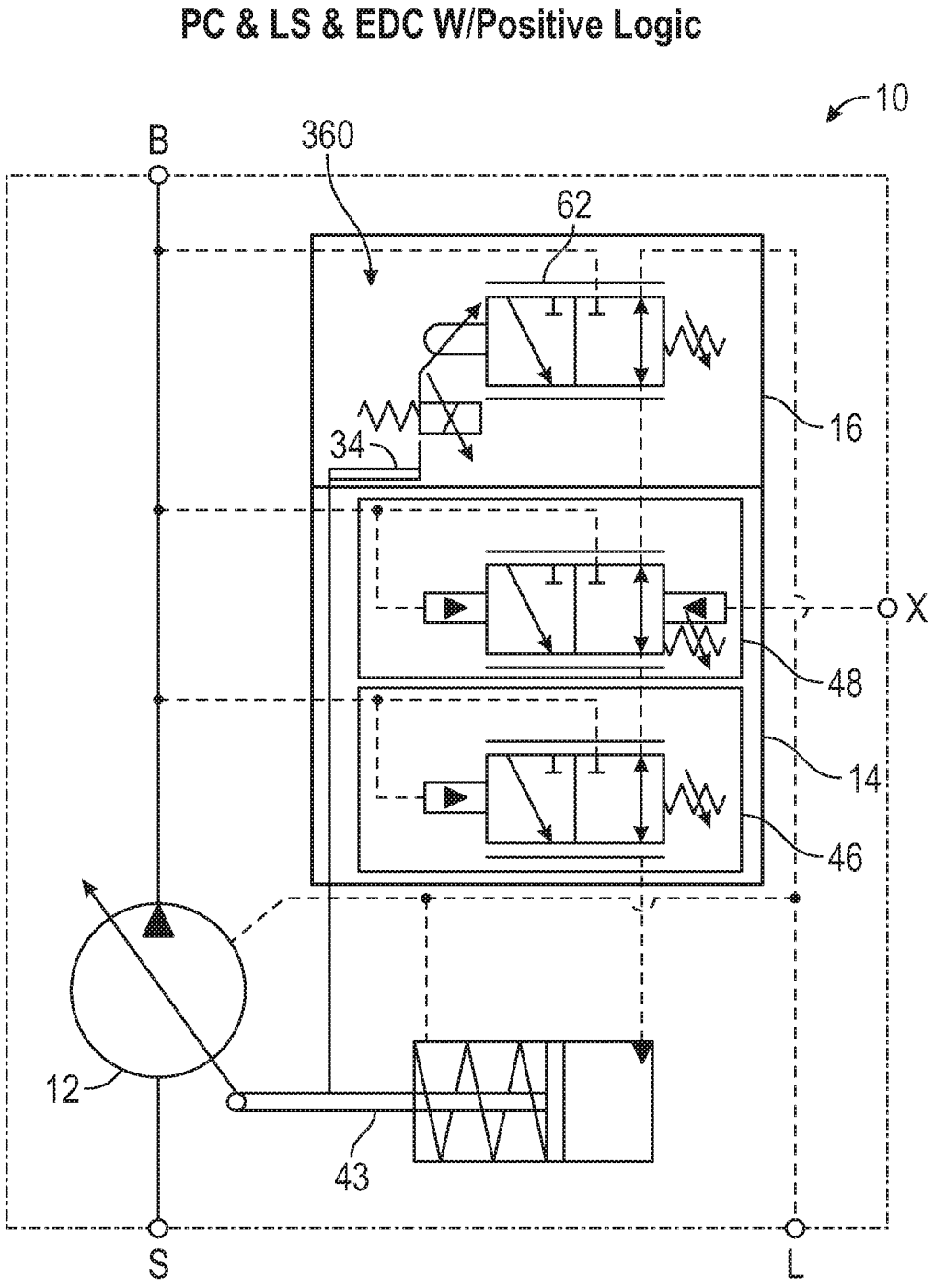
FIG. 9 a schematic diagram of the control arrangement of FIG. 1 in a fourth configuration.

Referring to FIG. 9, wherein like numerals represent like elements, a schematic view of a fourth configuration of the control arrangement 10 for controlling variable displacement pump 12 through servo piston 43 is shown. In the fourth configuration, the mechanical control unit 16 is in a second EDC configuration similar to the first EDC configuration, rather than an MTC or ETC configuration. The pressure control unit 14, including pressure compensator control portion 46 and load sensing control portion 48, of the control arrangement 10 is identical to the pressure control unit 14 shown in FIG. 3 and, therefore, the details of the pressure control unit 14 will not be discussed again in detail. The mechanical control unit 16 includes a rotary feedback assembly 360 controlling actuation of control spool 62 using rotary input from cam shaft 34 and an electronically set control setpoint.

With reference back to FIG. 7, the rotary feedback assembly 360 includes the same cam shaft 34, feedback pin 265 and spring 278 disposed within bore 266 formed in head 267 of the cam shaft 34, and rocker arm 268 that pivots about pivot point 269. The spring 278 disposed within bore 266 adjacent the feedback pin 265 provides the constant load on the feedback pin 265 against the rocker arm 268. The cam shaft 34 is rotatable in the transverse bore 33 and cam shaft opening 38 of pump housing 18, shown in FIG. 2. The cam shaft opening 38 of the pump housing 18, shown in FIG. 2, intersects a servo piston bore for servo piston 43. The servo piston 43 includes tapered portion 70 at the intersection between the servo piston bore and the cam shaft opening 38. The cam shaft 34 includes eccentric shoulder 71 that slides on the tapered portion 70 of the servo piston 43, such that the cam shaft 34 is driven in rotary motion in response to movement of the servo piston 43. Plunger 72 biased by spring 73 engages the cam shaft 34 to maintain contact between the cam shaft 34 and servo piston 43.

Figure 10:
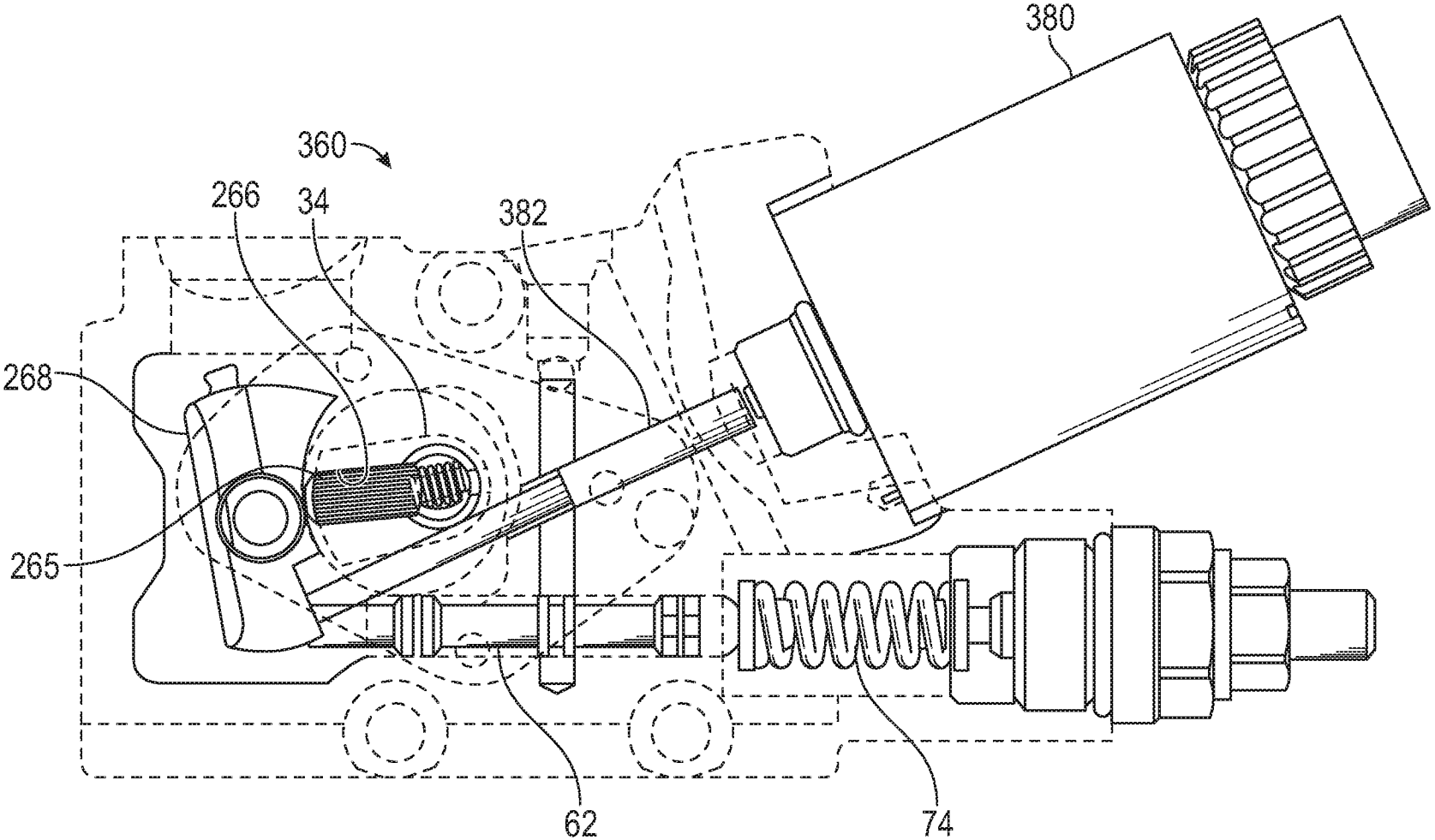
FIG. 10 is a partial cross sectional view of the mechanical control unit of FIG. 9.

Referring to FIG. 10, the rotary feedback assembly 360 includes a solenoid actuator 380 driving an actuator rod 382 positioned between the solenoid actuator 380 and the rocker arm 268 and force from the solenoid actuator 380 is exerted on rocker arm 268 via the actuator rod 282 to shift a control set point maintained by adjustable spring 74. However, in the configuration shown in FIG. 10, the moment generated by the solenoid actuator 380 on rocker arm 268 acts in the same direction as the moment on the rocker arm 268 from the adjustable spring 74, rather than the same direction as the moment from the feedback pin 265 as in FIG. 8. In this configuration, the control set point, which is the desired outlet flow at a given shaft speed, increases in response to actuation of the solenoid actuator 380. The control set point is again reached when the moment from the feedback pin 265 on rocker arm 268, the moment from adjustable spring 74 on rocker arm 268, and the moment from solenoid actuator 380 on rocker arm 268 are balanced and control spool 62 is centered in metering position.

Figure 11:
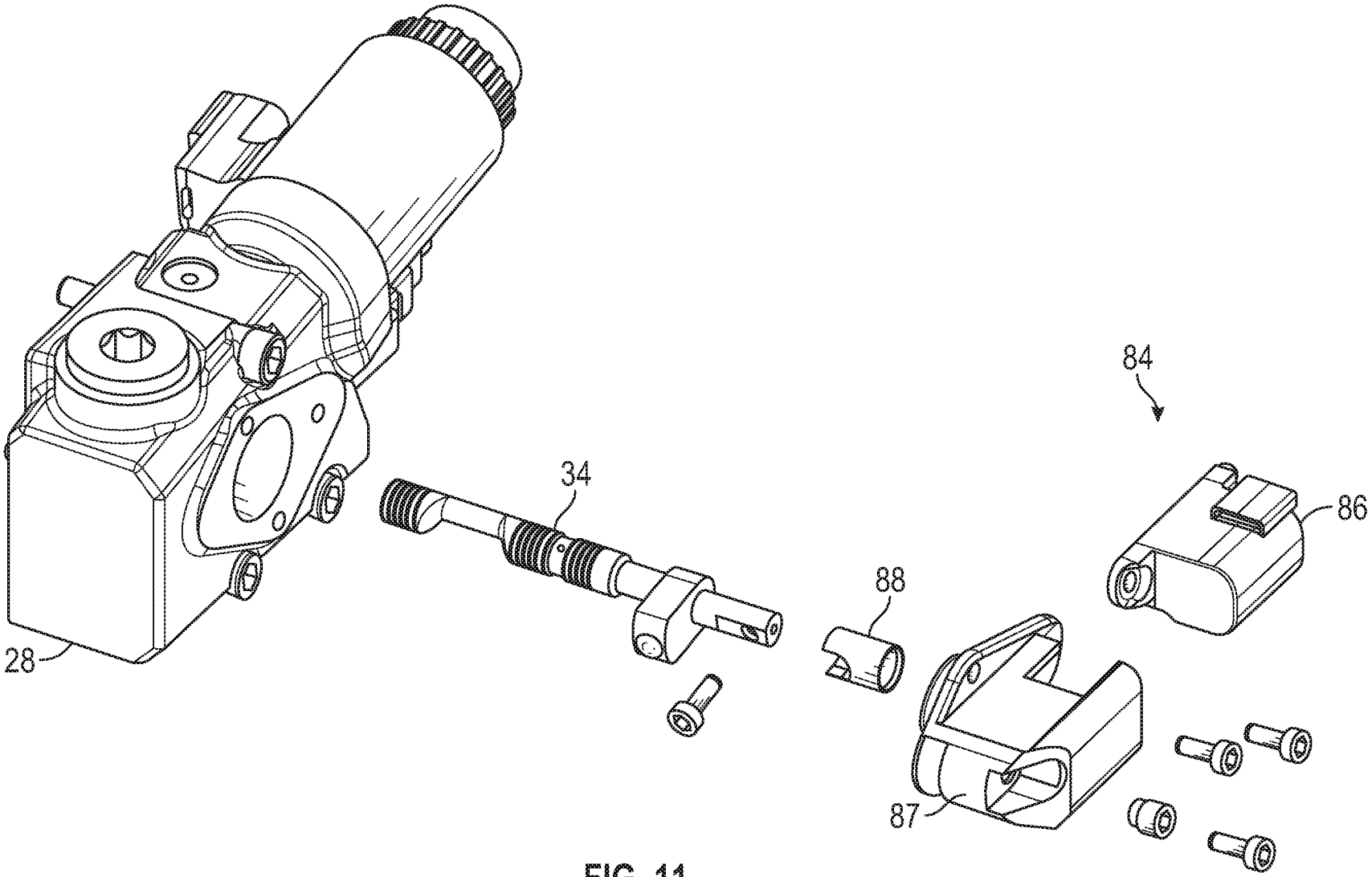
FIG. 11 is a partially exploded top, front, right-hand side perspective view of a mechanical control unit of the control arrangement of FIG. 1 with a sensor assembly.

Referring to FIG. 11, the mechanical control unit 14 may include a sensor assembly 84 that is bolted on to the mechanical control unit housing 28 in place of the removable cover 37, shown in FIG. 2. The sensor assembly 84 includes an angle sensor 86 disposed within a cover 87 that bolts to the housing 28. The angle sensor 86 detects an angle of the cam shaft 34 to determine pump displacement. For instance, the angle sensor 86 may be a magnetic sensor, such as Hall effect sensor or the like, that detects movement of a magnet carrier 88 disposed on an end of the cam shaft 34. While the angle sensor 86 is described in connection with the mechanical control unit 14, a variable displacement pump that does not include MTC, ETC or EDC control may still include the angle sensor 86 by providing an adapter cover with the cam shaft 34 solely for the purpose of providing the cam shaft angle for determining pump displacement.

The control arrangement 10 of the present disclosure advantageously provides a control-to-pump interface between the pressure control unit 14 and the pump 12 that requires only ports for hydraulic connections and advantageously provides a control-to-pump interface between the mechanical control unit 16 and the pump 12 that requires only ports for hydraulic connections and a single bore for cam shaft 34 of the rotary feedback assembly. Additionally, the distal end portion 36 of the cam shaft 34 that interfaces with servo piston 43 of the variable displacement pump 12 is advantageously the same for EDC, MTC, and ETC control.

Thus, the control arrangement 10 of the present disclosure may advantageously be used on multiple frame sizes of open circuit variable displacement pumps and product families by providing identical control-to-pump interfaces on each frame size for both the pressure control unit 14 and the mechanical control unit 16. This advantageously reduces the cost for the pumps by reducing variation of the pump controls as well as significantly reducing the total number of components.

The mechanical control unit 14 also advantageously implements the same concept of a rotary feedback system form EDC, MTC, and ETC control, thereby allowing a majority of the components (e.g. control housing, control spool, adjustable spring, and rocker arm) to be interchangeable regardless of the control type. This substantially reduces variation of large and more expensive components such as pump housings and swashplates across product families of variable displacement pumps. Furthermore, many other smaller components, such as the sensor assembly 84 and removable cover 37, may also advantageously be common for all frame sizes.

Additionally, separation of pressure controls in the pressure control unit 14 from the EDC, MTC, or ETC controls in the mechanical control unit 16 advantageously allows for significantly lower total number of components & control sub-assemblies for entire a product family, thereby reducing cost and making the product more attractive to customers.

While the principles of the present disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A control arrangement for a variable displacement pump, the control arrangement comprising:

a pressure control unit providing pressure compensation control and/or load sensing control; and a mechanical control unit providing at least one of mechanical torque control, electronic torque control, or electronic displacement control;

wherein the pressure control unit attaches to the variable displacement pump at a first interface and the mechanical control unit attaches to the variable displacement pump at a second interface that is different than the first interface;

wherein the mechanical control unit comprises a rotary feedback assembly configured to monitor actuation of a servo piston controlling displacement of the variable displacement pump and to control actuation of the servo piston based at least on the monitored actuation;

wherein the rotary feedback assembly comprises a cam shaft configured to engage the servo piston controlling displacement of the variable displacement pump;

wherein a control spool controlling actuation of the servo piston is actuated at least in part due to rotary motion of the cam shaft;

wherein the mechanical control unit further comprises a control setpoint adjuster;

wherein the control spool controls actuation of the servo piston based at least in part on rotary motion of the cam shaft and a control setpoint defined by the control setpoint adjuster;

wherein the rotary feedback assembly further comprises:

a rocker arm; and a feedback pin carried by the cam shaft and in contact with the rocker arm, the feedback pin being biased against the rocker arm by a working pressure of the variable displacement pump; and wherein the control spool controls actuation of the servo piston based at least in part on rotary motion of the cam shaft, a moment on the rocker arm due to the feedback pin, and the control setpoint defined by the control setpoint adjuster.

2. The control arrangement according to claim 1, wherein the mechanical control unit comprises: a housing including a pump mating surface configured to interface with the variable displacement pump at the second interface; wherein the cam shaft is disposed within the housing and has a distal end extending outward from the housing at the pump mating surface; wherein the distal end of the cam shaft is configured to engage the servo piston controlling displacement of the variable displacement pump when the mechanical control assembly is mounted to the variable displacement pump.

3. The control arrangement according to claim 2, further comprising a sensor assembly configured to detect an angle of the cam shaft to determine pump displacement.

4. A control arrangement for a variable displacement pump, the control arrangement comprising:

a pressure control unit providing pressure compensation control and/or load sensing control; and a mechanical control unit providing at least one of mechanical torque control, electronic torque control, or electronic displacement control;

wherein the pressure control unit is configured to attach to the variable displacement pump at a first mounting surface and the mechanical control unit is configured to attach to the variable displacement pump at a second mounting surface formed on an opposite side of the variable displacement pump from the first mounting surface;

wherein the mechanical control unit comprises a rotary feedback assembly configured to monitor actuation of a servo piston controlling displacement of the variable displacement pump and to control actuation of the servo piston based at least on the monitored actuation;

wherein the rotary feedback assembly comprises a cam shaft configured to engage a servo piston controlling displacement of the variable displacement pump;

wherein a control spool controlling actuation of the servo piston is actuated at least in part due to rotary motion of the cam shaft;

wherein the mechanical control unit further comprises a control setpoint adjuster;

wherein the control spool controls actuation of the servo piston based at least in part on rotary motion of the cam shaft and a control setpoint defined by the control setpoint adjuster;

wherein the rotary feedback assembly further comprises: a rocker arm; and a feedback pin carried by the cam shaft and in contact with the rocker arm, the feedback pin being biased against the rocker arm by a working pressure of the variable displacement pump; and wherein the control spool controls actuation of the servo piston based at least in part on rotary motion of the cam shaft, a moment on the rocker arm due to the feedback pin, and the control setpoint defined by the control setpoint adjuster.

5. The control arrangement according to claim 4, wherein the mechanical control unit comprises:

a housing including a pump mating surface configured to interface with the variable displacement pump at the second mounting surface;

wherein the cam shaft is disposed within the housing and having a distal end extending outward from the housing at the pump mating surface;

wherein the distal end of the cam shaft is configured to engage the servo piston controlling displacement of the variable displacement pump when the mechanical control assembly is mounted to the variable displacement pump.

6. The control arrangement according to claim 5, further comprising a sensor assembly configured to detect an angle of the cam shaft to determine pump displacement.

7. A control arrangement for a variable displacement pump, the control arrangement comprising: a mechanical control unit providing mechanical torque control, electronic torque control, and/or electronic displacement control, the mechanical control unit comprising: a housing including a pump mating surface configured to interface with the variable displacement pump; and a cam shaft disposed within the housing and having a distal end extending outward from the housing at the pump mating surface; wherein the distal end of the cam shaft is configured to engage a servo piston controlling displacement of the variable displacement pump when the mechanical control unit is mounted to the variable displacement pump; and wherein the mechanical control unit is configured to control a pressure to the servo piston from an output of the variable displacement pump; wherein the mechanical control unit comprises a rotary feedback assembly configured to monitor actuation of the servo piston through the cam shaft and to control displacement of the variable displacement pump through actuation of the servo piston based at least on rotary motion of the cam shaft; wherein the rotary feedback assembly controls movement of a control spool based at least in part on rotary motion of the cam shaft, the control spool controlling actuation of the servo piston; wherein the mechanical control unit further comprises a control setpoint adjuster controlling movement of the control spool; wherein the control spool controls actuation of the servo piston based at least in part on rotary motion of the cam shaft and a control setpoint defined by the control setpoint adjuster; wherein the rotary feedback assembly further comprises: a rocker arm; and a feedback pin carried by the cam shaft and in contact with the rocker arm, the feedback pin being biased against the rocker arm by a working pressure of the variable displacement pump; and wherein the control spool controls actuation of the servo piston based at least in part on rotary motion of the cam shaft, a moment on the rocker arm due to the feedback pin, and the control setpoint defined by the control setpoint adjuster.

8. The control arrangement according to claim 7, further comprising a sensor assembly configured to detect an angle of the cam shaft to determine pump displacement.

9. A control arrangement for a variable displacement pump, the control arrangement comprising:

a pressure control unit providing pressure compensation control and/or load sensing control;

a mechanical control unit providing at least one of mechanical torque control, electronic torque control, or electronic displacement control;

wherein the pressure control unit attaches to the variable displacement pump at a first interface and the mechanical control unit attaches to the variable displacement pump at a second interface that is different than the first interface;

wherein the mechanical control unit comprises a rotary feedback assembly configured to monitor actuation of a servo piston controlling displacement of the variable displacement pump and to control actuation of the servo piston based at least on the monitored actuation;

wherein the rotary feedback assembly comprises a cam shaft configured to engage the servo piston controlling displacement of the variable displacement pump;

wherein a control spool controlling actuation of the servo piston is actuated at least in part due to rotary motion of the cam shaft;

wherein the mechanical control unit further comprises a control setpoint adjuster;

wherein the control spool controls actuation of the servo piston based at least in part on rotary motion of the cam shaft and a control setpoint defined by the control setpoint adjuster;

wherein the rotary feedback assembly further comprises: a rocker arm; and a feedback pin carried by the cam shaft and in contact with the rocker arm, the feedback pin being biased against the rocker arm by a spring; and wherein the control spool controls actuation of the servo piston based at least in part on rotary motion of the cam shaft, a moment on the rocker arm due to the feedback pin, and the control setpoint defined by the control setpoint adjuster.

10. The control arrangement according to claim 9, wherein the rotary feedback assembly further comprises an actuator configured to actuate the rocker arm.

11. The control arrangement according to claim 9, wherein the rotary feedback assembly further comprises an actuator with an actuator rod, the actuator configured to exert a force on the rocker arm by moving the actuator rod.

* * * * *